US005662745A

United States Patent [19]

Takayama et al.

[11] Patent Number: 5,662,745

[45] Date of Patent: Sep. 2, 1997

[54] INTEGRAL ENGINE VALVES MADE FROM TITANIUM ALLOY BARS OF SPECIFIED MICROSTRUCTURE

[75] Inventors: Isamu Takayama, Futtsu; Satoshi Yamamoto; Masanori Kizaki, both of Hikari, all of Japan

[73] Assignee: Nippon Steel Corporation, Tokyo, Japan

[21] Appl. No.: 685,800

[22] Filed: Jul. 24, 1996

Related U.S. Application Data

[63] Continuation of Ser. No. 204,382, filed as PCT/JP93/00874, Jun. 28, 1993, published as WO94/02656, Mar. 2, 1994, abandoned.

[30] Foreign Application Priority Data

| | | | |
|---|---|---|---|
| Jul. 16, 1992 | [JP] | Japan | 4-189754 |
| Oct. 21, 1992 | [JP] | Japan | 4-283259 |
| Dec. 24, 1992 | [JP] | Japan | 4-344950 |
| Apr. 15, 1993 | [JP] | Japan | 5-088912 |

[51] Int. Cl.[6] ..... F01L 3/04; C23C 8/02

[52] U.S. Cl. ..... 148/237; 148/217; 148/317; 148/281; 428/472.1; 123/158.3; 251/368

[58] Field of Search ..... 148/421, 670, 148/671, 317, 902, 280, 281, 212, 211, 220, 237, 218; 428/472.1; 123/188.3; 251/368

[56] References Cited

U.S. PATENT DOCUMENTS

| | | | |
|---|---|---|---|
| 4,073,474 | 2/1978 | Hashimoto et al. | 123/188 AA |
| 4,433,652 | 2/1984 | Holtzberg et al. | 123/188 AA |
| 4,729,546 | 3/1988 | Allison | 123/188 AA |
| 4,834,036 | 5/1989 | Nishiyama et al. | 420/417 |
| 4,852,531 | 8/1989 | Abkowitz et al. | 123/188 AA |
| 5,125,986 | 6/1992 | Kimura et al. | 148/670 |
| 5,169,460 | 12/1992 | Mae | 148/421 |
| 5,304,263 | 4/1994 | Champin et al. | 148/421 |

FOREIGN PATENT DOCUMENTS

| | | | |
|---|---|---|---|
| 62-158856 | 7/1987 | Japan . | |
| 64-28347 | 1/1989 | Japan . | |
| 3-53049 | 3/1991 | Japan . | |
| 4-56097 | 9/1992 | Japan . | |
| 5279835 | 10/1993 | Japan | 148/281 |

*Primary Examiner*—James Engel
*Assistant Examiner*—Margery S. Phipps
*Attorney, Agent, or Firm*—Wenderoth, Lind & Ponack

[57] ABSTRACT

Bars of titanium alloys suited for the manufacture of at least the stems (2), (3) of engine valves are mass-producible while maintaining good configurational and dimensional accuracies throughout the valve fabricating process and the wear-resistance imparting processes to at least the stems (2), (3), by surface oxidizing and nitriding. The alloys are of the α+β type whose microstructure consists of any of an acicular α-phase consisting of acicular α crystals having a width of not smaller than 1 μm, an acicular α-phase consisting of acicular α crystals having a width of not smaller than 1 μm and dispersed with equiaxed α crystals, and an equiaxed α-phase consisting of α crystals whose diameter is not smaller than 6 μm. Their microstructure may also include one in which the diameter of the pre-β crystals in the acicular α-phase is not larger than 300 μm and the width of the acicular α crystals is not smaller than 1 μm and not larger than 4 μm. Selection of these alloys assures very efficient manufacture.

6 Claims, 1 Drawing Sheet

INTEGRAL ENGINE VALVES MADE FROM TITANIUM ALLOY BARS OF SPECIFIED MICROSTRUCTURE

This application is a continuation of now abandoned Ser. No. 08/204,382 filed Mar. 16, 1994, which is a national phase application of PCT/JP93/00874 filed Jun. 28, 1993.

FIELD OF THE INVENTION

This invention relates to titanium alloy bars for engine valves of automobiles, motorcycles and other motor vehicles that can be mass-produced, and more particularly to titanium alloy bars having such microstructures that no deformation occurs during heating in the manufacture of engine valves and no crack initiation and propagation during cold working in the manufacture of material bars.

BACKGROUND OF THE INVENTION

An intake and an exhaust valve in an engine combustion chamber of automobiles and other motor vehicles comprises a valve body, a valve stem extending therefrom, and the farthest end of the valve stem. A valve of this type is usually manufactured, for example, by cutting a steel rod having a diameter of 7 mm into a length of 250 mm. After upset-forging one end of the cut-length bar with electric heating (a process known as electrothermal upsetting), a mushroom-shaped valve body is roughly formed by hot die-forging. The semi-finished blank is finished to the desired final shape by applying stress-relief annealing, machining, grinding and surface treatments to provide wear resistance, such as soft nitriding, as requited.

The face, stem and stem end of engine valves are required to have adequate wear resistance. Because of their service environment, engine valves must have high-temperature strength, corrosion resistance and oxidation resistance. For this reason, conventional engine valves have generally been made of heat-resisting steels.

On the other hand, in recent years, there has been increasing demand for lighter engines to improve fuel consumption without lowering power output. Weight reduction of engine valves moving up and down at high speeds provide great contributions to the improvement of fuel consumption. Therefore, various attempts have been made at the use of titanium alloys having high specific strength. For instance, Ti—6Al—4V alloy, a typical example of the $\alpha+\beta$ type titanium alloys, has been extensively used for the manufacture of intake valves of racing cars. However, engine valves made of titanium alloys will not have high enough durability to withstand the abrasion resulting from the friction with the valve seat, guide and other parts if no improving treatment is applied. Though, therefore, conventional engine valves of titanium alloys are manufactured by the same method as those of heat-resisting steel, for example, molybdenum is sprayed onto their stems to impart high wear resistance. This additional process of molybdenum spraying is costly and uneconomical.

Other methods for imparting wear resistance to engine valves of titanium alloys have been also proposed, such as ion nitriding disclosed in Japanese Provisional Patent Publication No. 234210 of 1986, non-electrolytic nickel alloy plating disclosed in Japanese provisional Patent Publication No. 96407 of 1989, ion plating and nitriding disclosed in Japanese Provisional Patent Publication No. 81505 of 1986 and oxide scale formation disclosed in Japanese Provisional Patent Publication No. 256956 of 1987.

Each of these methods has its advantages and disadvantages. In non-electrolytic nickel alloy plating, for example, the oxide film that unavoidably forms on the surface of titanium alloy impairs the adherence of the coating. To avoid this impairment in coating adherence, the oxide film must be removed by such methods as shot blasting and pickling in fluoric acid. Otherwise, the impaired coating adherence must be improved by applying post-plating diffusion heat treatment. However, none of these corrective actions is favorable. Ion-plating is unsuited for mass-production because of its equipment limitations.

Oxidizing and nitriding in suitable environments are known to impart wear resistance at a relatively low cost. However, the heating at high temperature involved in these processes causes thermal deformation (especially the bending of valve stems) of valves made of the $\alpha+\beta$ type titanium alloy, thus defying the attainment of the desired configurational and dimensional accuracies. This problem may be solved by repeated strengthening of the stem or preparation of larger semi-finished blanks to allow the removal of deformed portions. However, these remedies are unfavorable and inefficient because titanium alloys are expensive and difficult to machine, as is described in page 74, No. 2, Vol. 35 of "Titanium and Zirconium." The configurational and dimensional changes are due to a very small creep deformation (approximately $2\times10^{-6}\%$) which a titanium alloy valve undergoes under the influence of a slight strain caused by its own weight (approximately 50 g) when it is subjected to oxidizing or nitriding at a temperature of 700° C. to 900° C.

Japanese Provisional Patent Publication No. 28347 of 1989 discloses a method for improving the creep properties in service environments of engine valves made of the $\alpha+\beta$ type titanium alloys. This method necessitates rendering the microstructure of the valve body into one consisting of finely dispersed acicular $\alpha$ crystals. Such a microstructure is obtained by prohibiting the formation of equiaxed $\alpha$ crystals by working the stock with a forging ratio of 2.5 or under in the $\alpha+\beta$ phase forming temperature zone after air- or water-cooling from the $\beta$-phase temperature zone.

Because of the need to limit the degree of working, this method separately fabricates the valve body and stem, then joins them together at a low enough temperature to prevent the destruction of the built-in microstructure, with the soundness of the produced joint subsequently inspected. Obviously, the process involving all these steps cannot be very efficient.

An object of this invention is to provide titanium alloy bars suited for the manufacture of engine valves whose valve body and stem can be integrally fabricated by conventional electrothermal upsetting. Titanium alloy bars according to this invention permit economical mass-production with less machining or grinding allowance than before as they do not cause significant dimensional and configurational changes (especially the bending of valve stems) when they are heated to high temperatures in stress-relief annealing. The economical oxidizing or nitriding process to impart the desired wear resistance can be also applied to the finished blanks made of this invention bars without dimensional and configuration changes.

Another object of this invention is to provide titanium alloy bars having good cold workability required in the manufacture of themselves.

SUMMARY OF THE INVENTION

The microstructure of the α+β type titanium alloy bars according to this invention consists of an acicular α phase consisting of acicular α crystals not less than 1 μm in width, an acicular α phase consisting of acicular α crystals not less than 1 μm in width and dispersed with equiaxed α crystals, or an equiaxed α phase consisting of α crystals not smaller than 6 μm in diameter. Titanium alloy bars having such microstructures permit mass-production of engine valves with good dimensional and configurational accuracies.

In particular, titanium alloy bars whose microstructure consists of an acicular α phase consisting of acicular α crystals not less than 1 μm and not more than 4 μm in width and containing pre-β crystals not larger than 300 μm in diameter assure the most efficient manufacture of engine valves.

DESCRIPTION OF THE PREFERRED EMBODIMENTS

A detailed description of this invention is given below.

One end of a bar of the α+β type titanium alloy according to this invention is formed into a ball by electrothermal upsetting in a β-phase temperature zone. Without being cooled to room temperature, the formed ball is then forged with a forging ratio of 3 to 10 in a β-phase or α+β-phase temperature zone and air-cooled. The forging ratio varies at different spots of the valve body because of its mushroom-like shape. The width of acicular α crystals in this microstructure are as large as 1 μm or above. Splitting of acicular α crystals occurs scarcely in the bars die-forged in the β-phase temperature zone, but substantially in those die-forged in the α+β-phase temperature zone, exhibiting some equiaxed α crystals as well.

Figure 2:
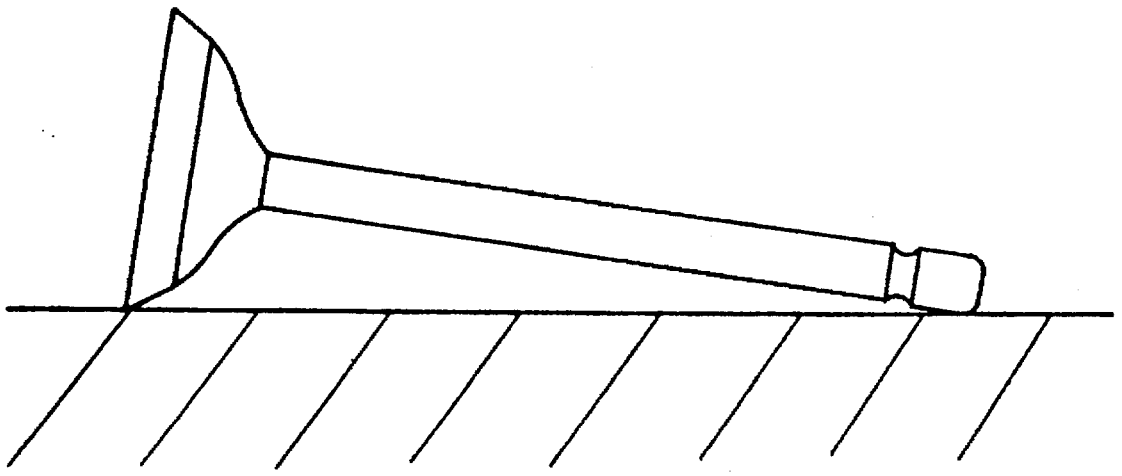
FIG. 2 shows an engine valve of this invention laid down in an oxidizing or nitriding furnace. In the figures, reference numeral 1 designates a valve body, 2 a valve stem, 3 the farthest end of the valve stem, and 4 a valve face.

The microstructure of the ordinary α+β type titanium alloy bars consists of fine-grained α crystals ranging between 2 and 4 μm in diameter. This can be explained as follows: In hot-rolling a 100 mm square billet into a 7 mm diameter bar from the β-phase temperature zone, for example, the stock becomes colder as its size reduction proceeds. Equiaxed α crystals are formed because the cooled stock is thoroughly worked in the α+β-phase temperature zone. The resultant hot-rolled rod in coil is then cold drawn to obtain a round cross-section, shaved for surface conditioning, and straightened (with annealing applied as required). To prevent cracking in these processes, the rod must have an elongation and a percentage reduction in area above a certain level which fine-grained equiaxed α crystals can provide. Small-diameter bars of Ti—6Al—4V alloy, a typical example of the α+β type titanium alloys, are used primarily for the manufacture of bolts and nuts for airplanes and other similar vehicles. Only those alloys which have microstructures of fine-grained α crystals having high strength and ductility are selected for these applications. The bars formed into valves by electrothermal upsetting as described before also have fine-grained equiaxed α-phase microstructures consisting of α crystals 2 to 4 μm in diameter. However, post-forging stress-relief annealing and oxidizing or nitriding to impart wear resistance are performed at high temperatures of approximately 700° C. or above in a furnace where the stocks are placed either horizontally as shown in FIG. 2 or on support nets. Therefore, some of the stocks thus heated are thermally deformed by their own weight.

This invention provides microstructures that inhibit the occurrence of such thermal deformation.

While Ti—6Al—4V titanium alloy, which accounts for the majority of titanium alloys, represents the α+β type titanium alloys made into bars according to this invention, Ti—6Al—2Sn—4Zr—2Mo, Ti—6Al—2Fe—0.1Si, Ti—3Al—2.5V, Ti—5Al—1Fe, Ti—5Al—2Cr—1Fe and Ti—6Al—2Sn—4Zr—6Mo alloys are also included.

These α+β type titanium alloys are selected because they have the mechanical properties engine valves are required to possess and the hot workability to permit the manufacture of small-diameter bars. Other types of titanium alloys, such as those of the α and near-α type, have high thermomechanical strength but low ductility. Therefore, they cannot be efficiently hot-worked into small-diameter crack-free rods without making special provision to prevent the in-process temperature drop. The β type titanium alloys are eliminated because their creep strength is too low to meet the mechanical properties requirements for engine valves. Besides, their extremely poor machinability and grindability do not permit efficient production.

The α+β type titanium alloys used in this invention must have a microstructure selected from among those consisting of an acicular α phase consisting of acicular α crystals not less than 1 μm in width, an acicular α phase consisting of acicular α crystals not less than 1 μm in width and dispersed with equiaxed α crystals, or an equiaxed α phase consisting of α crystals not smaller than 6 μm in diameter. This limitation is necessary to prevent the thermal deformation that might otherwise occur in the stress-relief annealing of the forged valve body and stem and the oxidizing or nitriding of the finished stock.

Any α+β type titanium alloy heated to the β-phase temperature zone and cooled at a rate slower than air-cooling forms an acicular α phase consisting of acicular α crystals not less than 1 μm in width. An α+β type titanium alloy having an equiaxed α-phase microstructure forms an acicular α phase dispersed with equiaxed α crystals when heated to a temperature just below the β-phase temperature zone and air-cooled. An α+β type titanium alloy having an equiaxed α-phase microstructure forms an equiaxed α phase consisting of α crystals not smaller than 6 μm in diameter when heated to the α+β-phase temperature zone and cooled slowly. Experience has shown that α crystals smaller than 6 μm are much more susceptible to thermal deformation than larger ones. On the other hand, there is a limit to the prevention of thermal deformation larger α crystals can achieve. Besides, too large α crystals take much time for size adjustment. Therefore, the upper size limit of α crystals should preferably be set at 25 μm. The width of acicular α crystals is limited to 1 μm or above because forming α crystals of smaller width necessitates water cooling. Water cooling produces strain that can lead to deformation during annealing, oxidizing and nitriding. The titanium alloys having the above micro-structures require heating for microstructure control and hot straightening to make up for losses of workability, in addition to an ordinary process for rolling small-diameter bars. A heat treatment to convert a fine-grained equiaxed microstructure into one consisting of equiaxed α crystals not smaller than 6 μm in diameter necessitates a measure to prevent thermal deformation.

Particularly, titanium alloys whose acicular α phase consists of pre-β crystals not larger than 300 μm in diameter and acicular α crystals measuring not less than 1 μm and not more than 4 μm in width permit the prevention of thermal deformation and the use of a conventional process for rolling small-diameter bars without modifications. An acicular α-phase microstructure having pre-β crystals not larger than 300 μm in diameter is obtained by completely breaking the coarse pre-β grains resulting from the heating of billets in the hot-rolling process by rolling in the β- and α+β-phase temperature zones and heating to a β-phase temperature zone for as short a period of time as from a few seconds to a few minutes by the heat generated by working. The obtained alloy has such an elongation and a percentage reduction in area as is enough to prevent cracking in the subsequent cold-drawing, shaving and straightening processes. Elongation falls below 10% when the diameter of pre-β grains exceed 300 μm. Then, cold drawing and straightening become difficult. On the other hand, there is no need to set the lower limit for the size of pre-β grains because thermal deformation does not occur so far as the microstructure is acicular, even if pre-β grains are unnoticeably small. From the viewpoint of fatigue strength, smaller pre-β grains are preferable.

Though acicular α crystals wider than 4 μm effectively prevent thermal deformation, those between 1 μm and 4 μm in width are preferable as the acicular α crystals in this size range prevent the lowering of fatigue strength in the valve stem. Titanium alloys with acicular α crystals under 1 μm in width, which are obtained by quenching hot-rolled stocks from the β-phase temperature zone, are difficult to straighten because of lack of elongation.

The inventors discovered that the growth of β crystals and the width of α crystals can be easily controlled in the manufacturing process of small-diameter bars and, therefore, acicular α phases having not only high resistance to thermal deformation but also high elongation and percent reduction in area can be obtained by conventional processes.

Titanium alloy bars according to this invention should preferably be hot-rolled to between 5 mm and 10 mm in diameter. Because of their low cold-drawability, it is preferable to hot-roll α+β type titanium alloys to a size closest possible to the diameter of the valve stem fabricated therefrom, leaving the minimum necessary machining allowance. This, in turn, permits faster cooling rate, thereby facilitating the prevention of the lowering of fatigue strength resulting from the growth of the diameter of pre-β crystals and the width of α crystals during the post-rolling cooling process from the β-phase temperature zone. Small-diameter stocks obtained with great reduction and possessing small heat capacity are preferable for the attainment of acicular crystals by taking advantage of the heat generated by rolling.

Billets are usually hot-rolled after heating to the β-phase temperature zone where deformability increases. To avoid the risk of oxidation-induced surface defects, however, they may be first heated to the α+β-phase temperature zone. Rolling in this temperature zone generates heat to raise the temperature to the β-phase zone where hot-rolling is completed.

A valve may be formed as described below. One end of a bar having a diameter of 7 mm and a length of 250 mm, for example, is upset-formed into a ball with a diameter of 20 to 25 mm by electrically heating to above the β transformation temperature where adequate deformability is obtainable. Without cooling to room temperature, the ball is die-forged into a valve body having a diameter of 36 mm. The air-cooled valve body is then annealed at a temperature between 700° C. and 900° C. and finished to the desired dimensional accuracy. The annealing temperature should preferably be not lower than the temperature employed in the subsequent wear-resistance imparting treatment or 800° C. Also, the cooling rate should preferably be lower than that of air-cooling to prevent the deformation caused by the stress-induced transformation during working or the introduction of strains during reheating.

Then, wear resistance is imparted by oxidizing and/or nitriding the fabricated titanium alloy valve at a temperature between 700° C. and 900° C. While wear resistance must be imparted to the face, stem and stem end of engine valves, the level of wear resistance varies with the type of engines and the material of mating members. For example, the valve face coming in contact with a valve seat of copper or copper alloys does not require any treatment. On the other hand, the stem end of rocker-arm type levers needs more wear resistance than can be imparted by oxidizing and/or nitriding. The use of tips of hardened steel or other strengthening measures are necessary. The treatment takes an extremely long time if the temperature is under 700° C. Over 900° C., by comparison, even the microstructure control described before cannot prevent thermal deformation that impairs the configurational and dimensional accuracies desired. However, the treatment temperature need not be limited to this range.

EXAMPLE 1

Table 1 shows the bending of the oxidized and/or nitrided stems of valves prepared from various types of Ti—6Al—4V titanium alloy bars having different microstructures. The alloys having the microstructures according to this invention exhibited extremely little thermal deformation. For imparting wear resistance to the valve stem, at least oxidizing (at 700° C. for one hour) proved necessary. Oxidizing and nitriding of the valve face and stem end proved to require higher temperature and longer time.

The microstructures shown in Table 1 were obtained by hot-working 100 mm square billets of titanium alloys in the α+β-phase temperature zone, fabricating the hot-worked stocks into 7 mm diameter bars whose microstructures consist of fine-grained equiaxed α crystals, and applying the following heat treatments:

Fine-grained equiaxed α-phase microstructure was obtained by annealing a bar at 700° C. The α crystals in this microstructure ranged from 2 to 4 μm in diameter.

Medium-grained equiaxed α-phase microstructure was obtained by heating a bar to 850° C. and subsequently cooling the heated bar slowly. The α crystals in this microstructure were approximately 6 μm in diameter.

Coarse-grained equiaxed α-phase microstructure was obtained by heating a bar to 950° C. and subsequently cooling the heated bar slowly. The α crystals in this microstructure were approximately 10 μm in diameter.

Acicular α-phase microstructure-1 was obtained by heating a bar to 980° C. and subsequently cooling the heated bar in air. The microstructure consisted of acicular α crystals not smaller than 1 μm in width and was dispersed with equiaxed α crystals.

Acicular α-phase microstructure-2 was obtained by heating a bar to 1010° C. for one minute and subsequently cooling the heated bar in air. While pre-β crystals had a diameter of approximately 40 μm, α crystals had a width of approximately 2 μm.

Acicular α-phase microstructure-3 was obtained by heating a bar to 1010° C. for one hour and subsequently cooling the heated bar in air. While pre-β crystals had a diameter of approximately 1000 μm, α crystals had a width of approximately 2 μm.

Acicular α-phase microstructure-4 was obtained by heating a bar to 1010° C. for one hour and subsequently cooling the heated bar in a furnace. While pre-β crystals had a diameter of approximately 1000 μm, α crystals had a width of approximately 5 to 20 μm.

The alloy bars having the microstructures described above were formed into valves each having a valve body with a diameter of 36 mm and a stem measuring 6.7 mm in diameter and 110 mm in length. While the valve body was formed by electrothermal upsetting, die-forging and machining, the valve stem was formed by centerless grinding.

The formed valve laid down as shown in FIG. 2 was oxidized by heating in the atmosphere at 700° C. to 900° C. for one hour, with subsequent cooling done in air. The bend in the valve stem was determined after removing scale. By rotating the 80 mm long stem, with both ends thereof supported, the maximum and minimum deflections in the middle was determined with a dial guage. Then, the value obtained by halving the difference between the maximum and minimum deflections was determined as the bend in the valve stem. Stem bends not greater than 10 μm are acceptable.

As is obvious from Table 1, no deformation occurred in acicular α-phase microstructure-4 heated at all temperatures up to 900° C., while the amount of deformation increased in medium-grained equiaxed α-phase microstructure heated at temperatures higher than 750° C.

TABLE 1

| Microstructure | 700° C. | 750° C. | 800° C. | 850° C. | 900° C. | Remarks |
|---|---|---|---|---|---|---|
| Fine-grained equiaxed α-phase microstructure | 30 | 100 | 400 | 700 | 1000 or above | Prepared for comparison |
| Medium-grained equiaxed α-phase microstructure | 1 | 10 | 60 | 200 | 500 | This invention |
| Coarse-grained equiaxed α-phase microstructure | 0 | 3 | 10 | 50 | 150 | This invention |
| Acicular a-phase microstructure-1 | 0 | 3 | 10 | 50 | 150 | This invention |
| Acicular α-phase microstructure-2 | 0 | 1 | 3 | 10 | 50 | This invention |
| Acicular α-phase microstructure-3 | 0 | 0 | 0 | 0 | 10 | This invention |
| Acicular α-phase microstructure-4 | 0 | 0 | 0 | 0 | 0 | This invention |

The numerals in the table indicate the amount of deformation in μm.

The specimens similarly nitrided indicated the same bending tendencies.

Other α+β type titanium alloys, such as Ti—6Al—2Sn—4Zr—2Mo, Ti—6Al—2Sn—4Zr—6Mo, Ti—6Al—2Fe—0.1Si, Ti—5Al—1Fe, Ti—5Al—2Cr—1Fe, and Ti—3Al—2.5V, also indicated the same bending tendencies.

EXAMPLE 2

Bars having the microstructures shown in Table 1 can be manufactured by ordinary conventional processes with some modifications. For example, conventional alloy bars having a fine-grained α-phase microstructure are manufactured by hot rolling. After adjusting their microstructure by furnace- or electric-heating, the bars are cold-straightened. Cracking in alloys with low elongation and percent reduction in area, such as one with an acicular α-phase microstructure, can be prevented by applying warm- or hot-straightening. It is of course preferable if they can be manufactured as efficiently as conventional alloy bars with a fine-grained equiaxed α-phase microstructure.

The possibility of manufacturing alloy bars having various microstructures by conventional methods was studied.

Alloy bars having acicular α-phase microstructure-2 proved to be manufacturable by conventional hot-rolling alone if the diameter of pre-β crystals is not larger than 300 μm and the width of acicular α crystals is not smaller than 1 μm and not greater than 4 μm. The alloy bars having acicular α-phase microstructure-2 can be achieved by rolling. After breaking the pre-β crystals by rolling billets in the α+β-phase temperature zone, the rolling speed and/or the draft per pass is increased in the latter stage of the rolling process to generate heat to raise the temperature into the β-phase zone. The rolled bars held in the β-phase temperature zone for approximately one minute to suppress the growth of β grains are then cooled in air. The bars thus obtained do not produce cracks during cold drawing and straightening because they have fair elongation and percentage reduction in area. For example, alloy bars containing pre-β crystals 300 μm in diameter and having an elongation of approximately 13% and a percent reduction in area of approximately 30% can be barely manufactured by a conventional process. The microstructure of alloy bars containing pre-β crystals approximately 20 μm in diameter and having an elongation of approximately 20% and a percent reduction in area of approximately 50% is similar to that of a conventional fine-grained equiaxed α-phase alloy. Table 2 shows the results of the study.

microstructure consisting of approximately 2 μm wide α crystals and pre-β crystals ranging from 30 μm to 60 μm in diameter.

The rod was then cold-drawn, shaved, straightened and centerless ground into a straight bar with a diameter of 7.0 mm.

One end of this bar was formed into a ball by electrothermal upsetting in the β-phase temperature zone (approximately 1050° C.). The ball was forged into a valve body which was annealed at 810° C. for one hour and subsequently cooled in air. This stock was finished into a 110 mm long valve having a valve body and stem with a diameter of 36 mm and 6.7 mm, respectively, by machining and grinding.

As shown at No. 1 in Table 3, the bend in the annealed stem was between 0 μm and 100 μm, which is a marked improvement over conventional valves (such as A and B in Table 3). Bends in the annealed valve stems not larger than 100 μm offer no problem.

The bends in the valve stems according to this invention were due to the release of strains induced by straightening. By comparison, those in the compared examples (A to G) were due to the combined effect of the same release of strains and creep deformation. The valves of this invention, laid down as shown in FIG. 2, caused bends of 0 μm to 3 μm

TABLE 2

| | Manufacture of Bar | | | | Thermal | | | |
|---|---|---|---|---|---|---|---|---|
| Microstructure | Hot Rolling | Cold Drawing | Shaving | Cold Straightening | Ease of Bar Manufacturing | Deformation in Valve Making | Overall Evaluation | Remarks |
| Fine grained equiaxed α-phase microstructure | ○ | ○ | ○ | ○ | ○ | X | X | Prepared for comparison |
| Medium-grained equiaxed α-phase microstructure | X | ○ | ○ | ○ | Δ | Δ | Δ | This invention |
| Coarse-grained equiaxed α-phase microstructure | X | ○ | ○ | ○ | Δ | ○ | ○ | This invention |
| Acicular α-phase microstructure-1 | Δ | ○ | ○ | ○ | ○ | Δ | ○ | This invention |
| Acicular α-phase microstructure-2 | ○ | ○ | ○ | ○ | ○ | ○ | ⊙ | This invention |
| Acicular α-phase microstructure-3 | X | X | ○ | X | Δ | ⊙ | ○ | This invention |
| Acicular α-phase microstructure-4 | X | X | ○ | X | Δ | ⊙ | ○ | This invention |

Legend:
○: No problem. Hot rolling marked with ○ directly build in the desired microstructure. Cold drawing and cold straightening marked with ○ cause no crack initiation and propagation.
Δ: Acceptable, though limits are narrow.
X: Impossible, unless the following processes are added or substituted: Hot rolling marked with X can produce the desired microstructure by applying suitable heat treatment to the hot-rolled alloy bar having a fine-grained equiaxed α-phase microstructure. Acicular α-phase microstructures-3 and -4 can be obtained irrespective of the type of microstructure before heat treatment. The problems with cold drawing and straightening marked with X are due to the small elongation (approximately 7%) and percent reduction in area (approximately 15%). Therefore, cracking can be prevented by applying warm- or hot-drawing and straightening.

EXAMPLE 3

Hot rolling of a 100 mm square billet of Ti—6Al—4V alloy was started at 1050° C. in the β-phase temperature zone and sufficiently continued in the α+β-phase temperature zone. The rolled rod, approximately 7.5 mm in diameter, was held for a short time in the β-phase temperature zone provided by the heat of working, with subsequent cooling done in air. The rod had an acicular α-phase when oxidized at 810° C. for one hour and bends of 5 μm to 10 μm when nitrided at 810° C. for ten hours, showing a marked improvement over conventional valves. The valves prepared for comparison were made from larger-diameter valve stocks, with their bends removed by machining after annealing.

The estimated fatigue strength, 50 kgf/mm$^2$, of the valve stems of this invention is equal to that of conventional ones. Creep strain in the valve bodies of this invention reached 0.1% under a pressure of 10 kg/mm$^2$ when maintained at 500° C. for 100 hours. Creep strength of this level is enough for engine valves.

Bend in each specimen was determined by halving the difference between the maximum and minimum deflections in the middle of the 80 mm long valve stem that was supported at both ends thereof and rotated. Bends not greater than 10 μm are acceptable.

Fatigue strength of each valve stem was estimated by Ono's rotating bend test using an 8 mm diameter specimen taken from a material having the same microstructure as that of the valve stem.

Creep strength of each valve body was estimated by a testing method according to JIS Z 2271 using a specimen taken from a material having the same microstructure as that of the valve body.

Table 3 shows engine valves made from alloys according to this invention (Nos. 1 to 11) that were treated similarly, together with other alloys prepared for the purpose of comparison (A to G). The width of acicular α crystals was varied by varying the rate of cooling after hot rolling. The engine valves made from the alloys of this invention all proved satisfactory. Estimated creep strength of the valve body differed little between the alloys of this invention and those prepared for comparison.

A durability test was made on titanium alloy valves oxidized at 810° C. for one hour and those nitrided at 810° C. for ten hours, using an engine having a valve guide made of a material equivalent to FC25 and a valve seat of a Fe—C—Cu alloy that was rotated at a speed of 6000 rpm for 200 hours. With regard to seizure on the valve stem and wear on the valve face, the valves according to this invention proved equal to or better than the conventional ones. A tip of hardened steel was fitted to each stem end.

Figure 1:
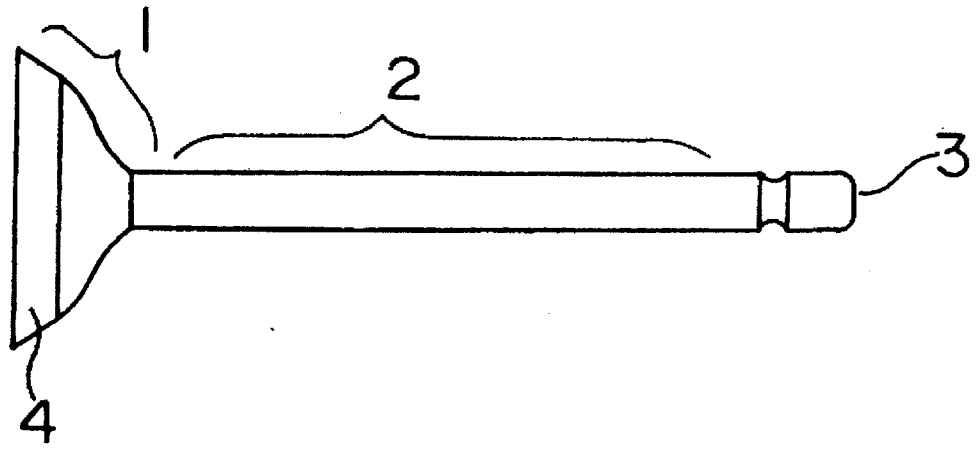
FIG. 1 is a side elevation of an engine valve made from a titanium alloy bar according to this invention.

C.) into a 9 mm diameter rod whose microstructure consisted of 2 μm to 4 μm diameter equiaxed α crystals. The rod was made into 7 mm diameter rods by applying drawing, shaving, the same heat treatments as in Example 1, straightening between 800° C. and 850° C., and centerless grinding. The resultant rods had fine-grained equiaxed α-phase, medium-grained equiaxed α-phase, coarse-grained equiaxed α-, acicular α-phase 1, 2, 3 and 4 microstructures. The rods were fabricated into valves each having a valve body diameter of 36 mm, stem diameter of 6.7 mm and a valve length of 110 mm as shown in FIG. 1. The valve body was formed by electrothermally upsetting one end of the rod into a ball in the β-phase temperature zone and die-forging in the α+β-phase temperature zone, with subsequent cooling done in air. The acicular α-phases in the longitudinal cross-sections of the obtained valves were cut apart by equiaxed α crystals. Commonly applied post-forging annealing was unnecessary because the rods were hot-straightened. Table 4 shows the bends in the valves oxidized in the upright position which were measured by the same method as in Example 1. Obviously, the bends in the valves of this invention were between 0 and 10 μm, which were a great improvement over the bends in the conventional valves (20 μm to 60 μm).

A durability test was made on the individual valves having different microstructures, using an engine having a valve guide made of a material equivalent to FC25 and a valve seat of a Fe—C—Cu alloy that was rotated at a speed of 6000 rpm for 200 hours. With regard to seizure on the valve stem and wear on the valve face, the valves according to this invention proved equal to or better than the conventional ones. A tip of hardened steel was fitted to each stem end.

TABLE 3

| No. | Titanium Alloy | Microstructure Cross Longitudinal Cross Section | Fatigue Strength (kgf/mm$^2$) | Bend in Annealed Valve Stem (μm) | Bend after Oxidizing or Nitriding (μm) | Judge-ment | Remarks |
|---|---|---|---|---|---|---|---|
| 1 | Ti—6Al—4V | 2 μm acicular | 50 | 0~100 | 0–10 | Good | This invention |
| 2 | Ti—6Al—4V | 3 μm acicular | 45 | 0~100 | 0–10 | Good | This invention |
| 3 | Ti—6Al—2Sn—4Zr—3Mo | 4 μm acicular | 45 | 0~100 | 0–10 | Good | This invention |
| 4 | Ti—3Al—2.5V | 2 μm acicular | 40 | 0~100 | 0–10 | Good | This invention |
| 5 | Ti—5Al—1Fe | 3 μm acicular | 50 | 0~100 | 0–10 | Good | This invention |
| 6 | Ti—5Al—2Cr—1Fe | 3 μm acicular | 50 | 0~100 | 0–10 | Good | This invention |
| 7 | Ti—6Al—2Fe—0.1Si | 3 μm acicular | 50 | 0~100 | 0–10 | Good | This invention |
| 8 | Ti—6Al—2Fe—0.1Si | 2 μm acicular | 50 | 0~100 | 0–10 | Good | This invention |
| 9 | Ti—6Al—2Sn—4Zr—6Mo | 3 μm acicular | 50 | 0~100 | 0–10 | Good | This invention |
| 10 | Ti—6Al—4V | 1 μm acicular | 50 | 0~100 | 0–10 | Good | This invention |
| 11 | Ti—6Al—4V | 4 μm acicular | 45 | 0~100 | 0–10 | Good | This invention |
| A | Ti—6Al—4V | 3 μm equiaxed | 50 | 400~500 | 400 minimum | Poor | Conventional |
| B | Ti—6Al—4V | 4 μm equiaxed | 50 | 400~500 | 400 minimum | Poor | Conventional |
| C | Ti—3Al—2.5V | 4 μm equiaxed | 40 | 400~500 | 400 minimum | Poor | Conventional |
| D | Ti—5Al—1Fe | 4 μm equiaxed | 50 | 400~500 | 400 minimum | Poor | Conventional |
| E | Ti—5Al—2Cr—1Fe | 4 μm equiaxed | 50 | 400~500 | 400 minimum | Poor | Conventional |
| F | Ti—6Al—2Fe—0.1Si | 4 μm equiaxed | 50 | 400~500 | 400 minimum | Poor | Conventional |
| G | Ti—6Al—2Sn—4Zr—6Mo | 4 μm equiaxed | 50 | 400~500 | 400 minimum | Poor | Conventional |

Oxidizing and nitriding (except for Ti—3Al—2.5V) were performed by keeping the specimens at 810° C. for one hour and ten hours, respectively, in a furnace as shown in FIG. 2.

EXAMPLE 4

A 100 mm square billet of Ti—6Al—4V alloy was rolled in the α+β-phase temperature zone (at approximately 950°

TABLE 4

| Microstructure of Titanium Alloy Rod | Wear-resistance Imparting Heat Treatment (in Upright Position) | Bend in Heat Treated Valve Stem (μm) | Results of Durability Test on Engine | Remarks |
|---|---|---|---|---|
| Fine-grained equiaxed α-phase | Oxidized at 850° C. for 1 hour | 20~60 | Untestable due to off-tolerance dimensions | Conventional |
| Medium-grained equiaxed α-phase | Oxidized at 850° C. for 1 hour | 5~10 | Good | This invention |
| Coarse-grained equiaxed α-phase | Oxidized at 850° C. for 1 hour | 0~5 | Good | This invention |
| Acicular α-phase - 1 | Oxidized at 850° C. for 1 hour | 0~10 | Good | This invention |
| Acicular α-phase - 2 | Oxidized at 850° C. for 1 hour | 0 | Good | This invention |
| Acicular α-phase - 3 | Oxidized at 850° C. for 10 hours | 5~10 | Good | This invention |
| Acicular α-phase - 4 | Oxidized at 900° C. for 1 hour | 5~10 | Good | This invention |

EXAMPLE 5

A 100 mm square billet of Ti—3Al—2.5V alloy was rolled in the α+β-phase temperature zone (at approximately 930° C.) into a 9 mm diameter rod whose microstructure consisted of 4 μm diameter equiaxed α crystals. The rod was made into 7 mm diameter rods by applying drawing, shaving, the same heat treatments as in Example 1, except that the temperatures were lowered by 20° C. each, straightening between 800° C. and 850° C., and centerless grinding. The resultant rods had fine-grained equiaxed α-phase, medium-grained equiaxed α-phase, coarse-grained equiaxed α-phase, acicular α-phase 1, 2, 3 and 4 microstructures. The rods were fabricated into valves each having a valve body diameter of 36 mm, stem diameter of 6.7 mm and a valve length of 110 mm as shown in FIG. 1. The valve body was formed by electrothermally upsetting one end of the rod into a ball in the β-phase temperature zone and die-forging in the α+β-phase temperature zone, with subsequent cooling done in air. The microstructures in their longitudinal cross-section were made up of elongated pre-β crystals, with the acicular α-phases scarcely cut apart. Commonly applied post-forging annealing was unnecessary because the rods were hot-straightened.

Table 5 shows the bends in the valves oxidized in the upright position which were measured by the same method as in Example 1.

The bends in the valves of this invention were between 0 and 10 μm, which were a great improvement over the bends in the conventional valves (20 μm to 60 μm).

A durability test was made on the individual valves having different microstructures, using an engine having a valve guide made of a material equivalent to FC25 and a valve seat of a Fe—C—Cu alloy that was rotated at a speed of 6000 rpm for 200 hours. With regard to seizure on the valve stem and wear on the valve face, the valves according to this invention proved equal to or better than the conventional ones. A tip of hardened steel was fitted to each stem end.

TABLE 5

| Microstructure of Titanium Alloy Rod | Wear-resistance Imparting Heat Treatment (in Upright Position) | Bend in Heat Treated Valve Stem (μm) | Results of Durability Test on Engine | Remarks |
|---|---|---|---|---|
| Fine-grained equiaxed α-phase | Oxidized at 810° C. for 1 hour | 20~60 | Untestable due to off-tolerance dimensions | Conventional |
| Medium-grained equiaxed α-phase | Oxidized at 810° C. for 1 hour | 5~10 | Good | This invention |
| Coarse-grained equiaxed α-phase | Oxidized at 810° C. for 1 hour | 0~5 | Good | This invention |
| Acicular α-phase - 1 | Oxidized at 810° C. for 1 hour | 0~10 | Good | This invention |
| Acicular α-phase - 2 | Oxidized at 810° C. for 1 hour | 0 | Good | This invention |
| Acicular α-phase - 3 | Oxidized at 810° C. for 10 hours | 5~10 | Good | This invention |
| Acicular α-phase - 4 | Oxidized at 860° C. for 1 hour | 5~10 | Good | This invention |

Use in Industrial Applications

The titanium alloy bars of this invention which can be efficiently produced assure economical manufacture of engine valves as they eliminate thermal deformation, possess good wear resistance imparted by economical oxidizing and nitriding, and permit the use of conventional manufacturing processes without modifications.

What is claimed is:

1. An engine valve of titanium alloy with at least a valve stem thereof having a microstructure consisting essentially of an acicular α-phase consisting of acicular α crystals with a width of not less than 1 μm and not more than 4 μm, wherein at least said valve stem has high wear resistance imparted by oxidation or nitriding.

2. An engine valve of titanium alloy with at least a valve stem thereof having a microstructure consisting essentially of an acicular α-phase consisting of acicular α crystals with a width of not less than 1 μm and not more than 4 μm, and pre-β crystals having a grain diameter of not larger than 300 μm, wherein at least said valve stem has high wear resistance imparted by oxidation or nitriding.

3. In a method of imparting wear resistance to an engine valve of titanium alloy, which comprises subjecting the valve to at least one treatment selected from the group consisting of oxidizing and nitriding, the improvement wherein the valve is made of a titanium alloy having a microstructure consisting essentially of an acicular α-phase having acicular α crystals with a width of not less than 1 μm and not more than 4 μm, and said treatment is conducted without thermally deforming the valve.

4. The method according to claim 3, wherein said treatment is conducted at between 700° C. and 900° C.

5. In a method of imparting wear resistance to an engine valve of titanium alloy, which comprises subjecting the valve to at least one treatment selected from the group consisting of oxidizing and nitriding, the improvement wherein the valve is made of a titanium alloy having a microstructure consisting essentially of an acicular α-phase consisting of acicular α crystals with a width of not less than 1 μm and not more than 4 μm, and pre-β crystals having a grain diameter of not larger than 300 μm, and said treatment is conducted without thermally deforming the valve.

6. The method according to claim 5, wherein said treatment is conducted at between 700° C. and 900° C.

* * * * *